US007207272B2

(12) United States Patent
Kinoshita

(10) Patent No.: US 7,207,272 B2
(45) Date of Patent: Apr. 24, 2007

(54) IDENTIFIABLE BULLET WHICH IS UNDUPLICATABLE

(76) Inventor: Haruyuki Kinoshita, 3-5-4, Osaki, Shinagawa-ku, Tokyo, 141-0032 (JP)

( * ) Notice: Subject to any disclaimer, the term of this patent is extended or adjusted under 35 U.S.C. 154(b) by 0 days.

(21) Appl. No.: 11/288,350

(22) Filed: Nov. 29, 2005

(65) Prior Publication Data

US 2006/0101691 A1 May 18, 2006

Related U.S. Application Data

(63) Continuation of application No. PCT/JP2005/009822, filed on May 23, 2005.

(30) Foreign Application Priority Data

May 31, 2004 (JP) ..... 2004-187059

(51) Int. Cl.
*F41A 9/53* (2006.01)

(52) U.S. Cl. ..... 102/430; 42/1.01

(58) Field of Classification Search ..... 42/1.01
See application file for complete search history.

(56) References Cited

U.S. PATENT DOCUMENTS

| | | | | |
|---|---|---|---|---|
| 1,650,908 | A * | 11/1927 | Ramsey | 42/106 |
| 1,887,324 | A * | 11/1932 | Pocoroba | 40/629 |
| 4,150,624 | A | 4/1979 | Hammond | |
| 4,175,346 | A * | 11/1979 | Zemsky | 42/76.01 |
| 5,485,789 | A * | 1/1996 | Collier | 102/501 |
| 5,511,483 | A | 4/1996 | Griffin, Jr. | |
| 5,698,816 | A * | 12/1997 | Roxby | 102/516 |
| 5,737,709 | A * | 4/1998 | Getty et al. | 134/22.1 |
| 5,758,446 | A * | 6/1998 | Atchison | 42/78 |
| 6,069,955 | A | 5/2000 | Coppersmith et al. | |
| 6,293,204 | B1 * | 9/2001 | Regen | 102/430 |
| 2002/0178959 | A1 | 12/2002 | Rennard | |
| 2003/0217665 | A1 * | 11/2003 | Rennard | 102/430 |
| 2004/0200108 | A1 * | 10/2004 | Dairon et al. | 42/1.01 |
| 2005/0045056 | A1 * | 3/2005 | EkenediliChukwu | 102/430 |
| 2006/0026880 | A1 * | 2/2006 | Lizotte et al. | 42/1.01 |
| 2006/0101691 | A1 * | 5/2006 | Kinoshita | 42/1.01 |

FOREIGN PATENT DOCUMENTS

| | | | |
|---|---|---|---|
| GB | 2295001 | A * | 5/1996 |
| WO | WO 9726501 | A1 * | 7/1997 |

* cited by examiner

*Primary Examiner*—Troy Chambers
(74) *Attorney, Agent, or Firm*—Westerman, Hattori, Daniels & Adrian, LLP.

(57) ABSTRACT

This identifiable bullet which is unduplicatable by a third party places plural (two or more) sets of identification codes onto or into a bullet and to make the identification codes in concordance. Thus, the bullet remains identifiable. At least one set of the identification code or codes can be encrypted. In this way, the mutual relations among the identification codes become confidential to a third party, so that the bullet becomes unduplicatable. In one embodiment, each identification code is placed on a different kind of material, and this enables an investigator to detect and compare the identification codes more easily after shooting of the bullet.

5 Claims, 4 Drawing Sheets

IDENTIFIABLE BULLET WHICH IS UNDUPLICATABLE

This application is a continuation of international application PCT/JP2005/009822 filed on May 23, 2005.

BACKGROUND OF THE INVENTION

1. Field of the Invention

The present invention relates to bullets used for firearms such as guns and, in particular, intends to prevent gun-used criminal offenses through wide use of such bullets.

2. Background of the Invention

Criminal offenses in which firearms such as guns are used cast a dark shadow over nations where the possession and use of weapons are allowed (e.g. United States). In gun-used crimes, it is difficult to identify the criminal(s), because the gun is gone with the criminal(s). There is a method of identifying the firearm used in a criminal offense based on a mark impressed on a projectile after shooting (hereafter optionally called a "striated mark"). This method, recently, has been indispensable for investigations of gun-used crimes.

The striated mark refers to a mark impressed on projectiles, more specifically, bullets shot from a firearm. An identical striated mark is impressed on the bullets shot from the firearm. Accordingly, investigation of the striated mark allows identification of the firearm used in a criminal offense, and this method is believed to prevent gun-used crimes. However, few bullets which are treated as evidence in gun-used incidents are submitted intact, or most bullets submitted are badly distorted, wiped and/or fragmented. Thus, the striated marks are still not almighty for identifying bullets (cf. Bullet Identification (Internet homepage distributed by FirearmsID.com)non-patent publication 1).

In order to solve this problem, or in other words, clear the limitation presented by the method of identifying the used firearm by means of the striated mark, and to prevent gun-used crimes, some precursors reached and disclosed the idea of placing an identification code or codes in advance onto a bullet or an ammunition.

U.S. Pat. No. 1,650,908 issued to Ramsey discloses an ammunition marking system that includes forming a single identification code on a rear face of a bullet.

U.S. Pat. No. 5,698,816 issued to Roxby discloses an identifiable bullet in which an identification member with an identification code is embedded so that the identification code will remain legible following cartridge discharge, bullet impact and post firing environments.

WO 2005/024337 invented by Mace discloses an identifiable ammunition wherein a single identification code is placed onto plural identification surfaces.

Now there must be remembered one important premise for enabling us to identify the bullet or ammunition by use of the above-mentioned identifiable bullets or ammunitions. The premise is that only one identifiable bullet exists in this world just like a fingerprint does.

The identifiable bullet in which the one set of identification code or codes, referred to in the above-mentioned bullets, is placed explicitly or identifiable by eyesight cannot avoid the problem of duplication (forgery) by a third party.

Duplication mentioned here means, to a lesser extent, producing an identical bullet to the identifiable bullet presented to a forger, or rather, to much extent, that a duplicator arbitrarily produces an identifiable bullet with its identification code or codes which becomes accidentally identical to an identification code of an identifiable bullet whose owner is irrelevant to the duplicator.

Thus, the objective of the present invention is to provide an identifiable bullet which is unduplicatable by a third party.

Non-patent publication 1

Bullet Identification (Internet homepage distributed by FirearmsID.com.)

SUMMARY OF THE INVENTION

The above objective will be accomplished by the following identifiable bullet.

By placing plural (two or more) sets of identifiable codes onto or into a bullet and by making these identification codes mutually related, the bullet remains identifiable. Then, by making at least one set of the identification code or codes ciphered, the mutual relations among the identification codes become confidential to a third party, so that the bullet will be unduplicatable.

DETAILED DESCRIPTION OF THE INVENTION

An identifiable and unduplicatable bullet of the present is instructed by referring to drawings.

Figure 1:
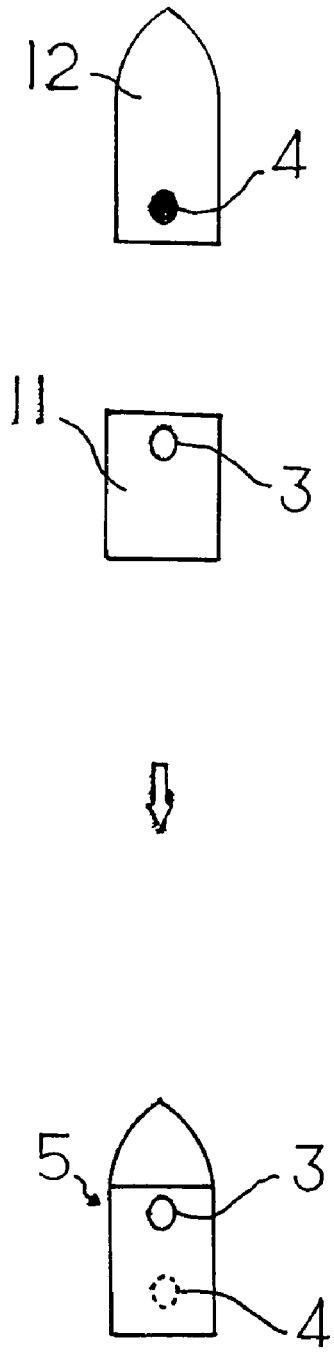
FIG. 1 is a schematic representing an example of an identifiable bullet of the present invention.

FIG. 1 illustrates an identifiable bullet of the present invention, having plural sets of identification codes, in which an unciphered identification code (or codes) 3 and a ciphered identification code (or codes) 4 are mutually related. In the present invention, identification codes consist of one or more sets of unciphered identification code (or codes) and one or more sets of ciphered identification code (or codes).

In one embodiment, the unciphered identification code 3 is placed on the surface of a jacket 11, the ciphered identification code 4 is placed on the surface of a bullet core 12, and then, the bullet core 12 is inserted into the jacket 11, so that the ciphered identification code 4 is embedded in a bullet 5. Conversely, the unciphered identification code 3 may be embedded inside the bullet 5 and the ciphered identification code may be placed onto the surface of the bullet 5.

Both the method of placing the ciphered identification code 3 onto the surface of the jacket 11 and the method of placing the ciphered identification code 4 onto the surface of the bullet core 12 are taught by the disclosure of WO 2005/024337, i.e., these identification codes are placed by well-known methods such as engraving, stamping, molding, photoengraving, photolithography and the like.

Figure 4:
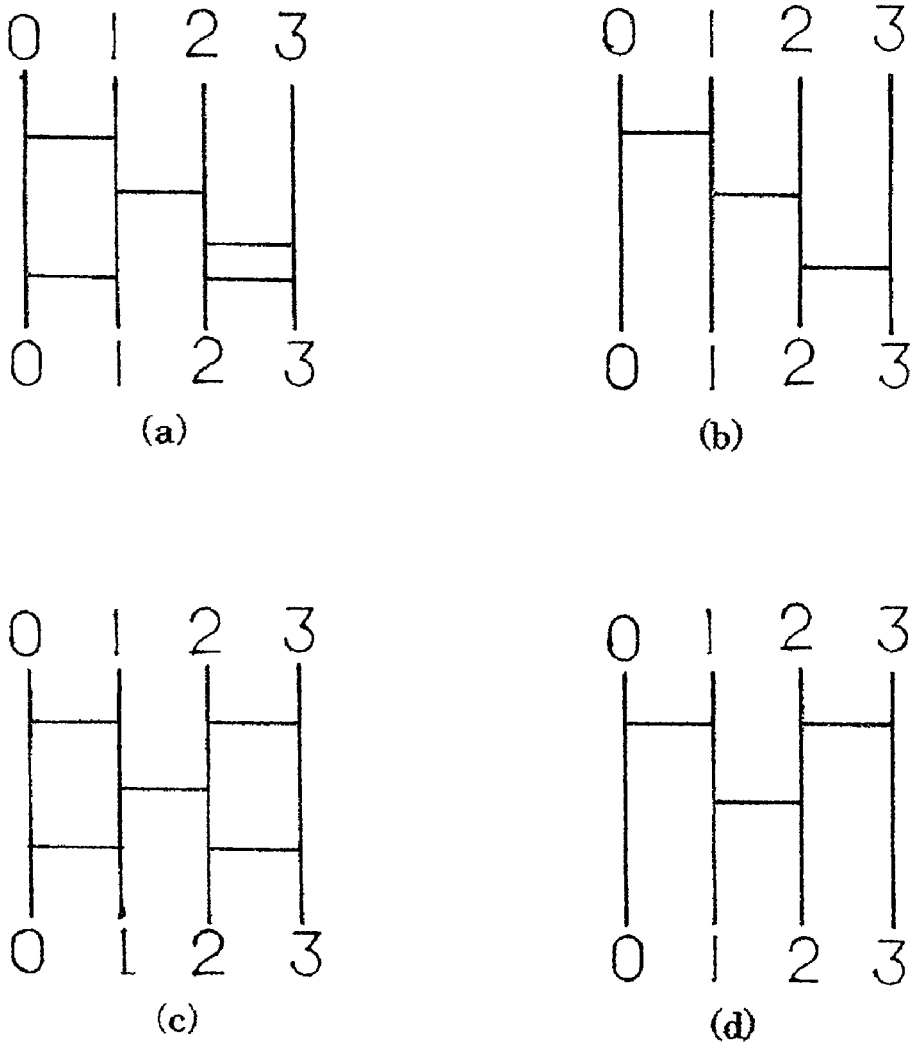
FIG. 4 is a schematic representing an example of the way of determining one set of ciphered identification code (or codes) in an identifiable bullet of the present invention.

In the present invention, the ciphered identification code 4 corresponding to the unciphered identification code 3 can be determined by any method and there is no limitation for it. FIG. 4 illustrates one way of determining the ciphered identification code 4 based on the unciphered identification code 3.

A ladders-shaped chart is assigned to each of (a), (b), (c) and (d) of FIG. 4. Each chart follows the rule that one goes downward along with the vertical line from any of the four starting points on the top where the four numbers 0, 1, 2 and 3 are placed, and if he encounters a horizontal line, he follows the horizontal line, and he finally reaches any of the four goals in the bottom where the four number 0, 1, 2 and 3 are place, and he connects the number at the goal he reached with the number at the starting point. Next, any four digit number consisting of four digits 0, 1, 2 and 3 are supposed, and chart (a) corresponds to the first digit (left-most digit), in the similar manner, chart (b) to the second digit, chart (c) to the third digit and chart (d) to the fourth digit (the right-most digit). Then, the ciphered identification code corresponding to a four digit number, e.g., 0123 can be obtained by applying the above rule to the four charts. They teaches that the first digit 0 corresponds to 2, the second digit 1 corresponds to 0, the third digit 2 corresponds to 2 and the fourth digit 3 corresponds to 1, and finally the ciphered identification code 4, connected with the unciphered identification code 3, 0123 in the present case, is 2021.

In the present invention, any kind of characters can be used for identification codes, e.g., the 36 characters consisting of letters of the alphabet and numbers of 0 through 9 can be used. In another embodiment, barcords or binary codes as disclosed in U.S. Pat. No. 6,293,204.

Figure 2:
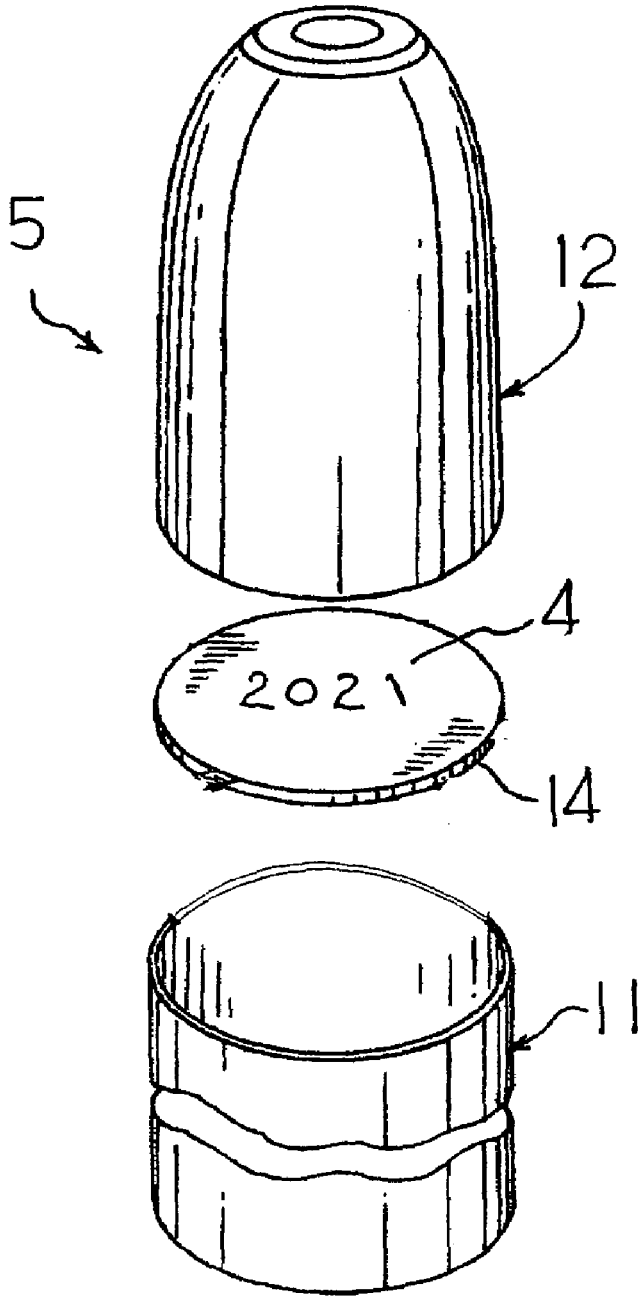
FIG. 2 is a schematic representing an example of the method of embedding a member with one set of identification code (or codes) inside the identifiable bullet.

FIG. 2 illustrates one way of embedding a member with an identification code (or codes) into the bullet. The present example follows the disclosure of U.S. Pat. No. 5,698,816: inserting a member 14 on which the identification code (either the unciphered identification code 3 or the ciphered identification code 4) is placed into the jacket 11 and then inserting the bullet core 12 into the jacket 11. The member 14 on which the identification code (or codes) is placed can be prepared by punching the sheet on which the identification codes are placed. This method is also fully disclosed in U.S. Pat. No. 5,698,816.

Figure 3:
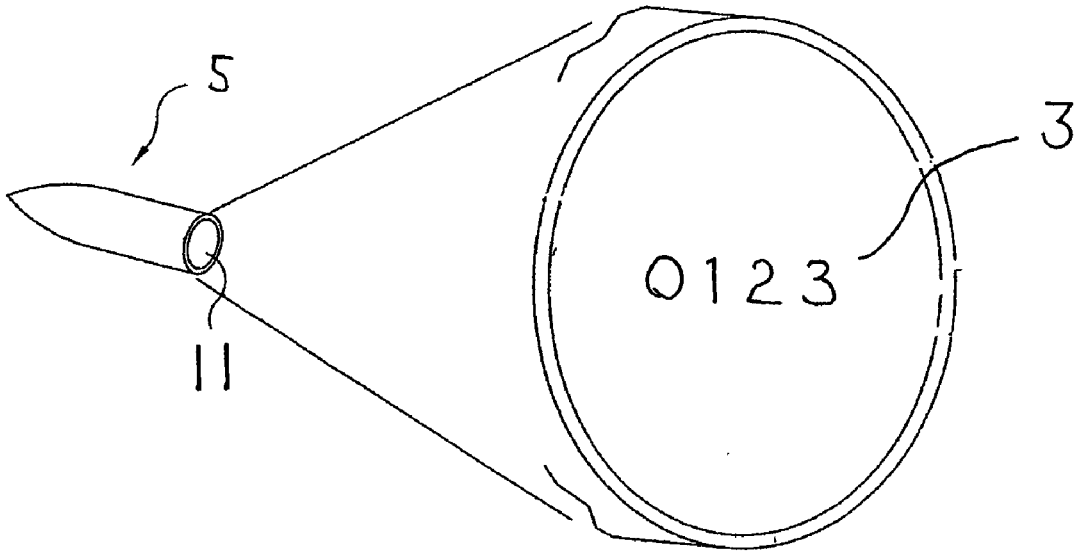
FIG. 3 is a schematic representing an example of the method of placing one set of identification code (or codes) onto a bullet surface.

FIG. 3 illustrates one example of a bullet on whose surface an identification code (or codes) is placed. This identification code in this example can be placed by following the disclosure of WO 2005/024337, i.e., placing the identification code (either the unciphered identification code 3 or the ciphered identification code 4) onto the rear face of the bullet by the well-known methods such as engraving, stamping, molding, photoengraving, photolithography and the like.

In one embodiment of the present invention, an identifiable bullet can be prepared by placing three or more sets of identification codes unless the mutual relationships among these identification codes are so complicated. Such bullets present the same advantage as a bullet with one set of multiple identification codes does, i.e., the likelihood that any of the identification codes remains intact after shooting is siginificantly enhanced.

In another embodiment of the present invention, each identification code can be placed in a different kind of material. This embodiment enables us to clearly distinguish one identification code from another identification code in comparison with the case that every identification code is placed in one kind of material. Consequently, this embodiment enables us to detect and compare identification codes more easily in a investigation.

For example, an unciphered identification code 3 can be placed on the rear face of the bullet 5 which is made of one kind of metal and a ciphered identification code 4 can be placed onto a member 14 which is made of the material selected from the group consisting of another kind of metal, textile and paper as disclosed in U.S. Pat. No. 5,698,816, and the member 14 with the ciphered identification code 4 can be embedded.

In the example illustrated by FIG. 2 and FIG. 3, the unciphered identification code 3, 0123, is placed onto the rear face of the bullet, and the ciphered identification code 4, 2021, is placed onto the member 14 and the member 14 is embedded into the bullet. The code 0123 as the unciphered identification code 3 and the code 2021 as the ciphered identification code 4 obey the mutual relationships following the charts in FIG. 4.

It will be evident to the skilled in the art that the present invention is not limited to the foregoing illustrative examples, and that it can be embodied in other specific forms without departing from the essential attributes thereof. It is therefore desired that the examples be considered in all respects as illustrative and not restrictive, reference being made to the appended claims, rather than to the foregoing examples, and all changes which come within the meaning and range of equivalency of the claims are therefore intended to be embraced therein.

INDUSTRIAL APPLICABILITY

As described above, an identifiable and unduplicatable bullet of the present invention is so useful that it can prevent gun-used crimes.

What is claimed is:

1. An identifiable bullet comprising:

a bullet core; and a jacket to hold said bullet core, wherein said identifiable bullet includes a plurality of sets of identification codes, and wherein a first set of said identification codes is in an encrypted concordance with a second set of said identification codes.

2. The identifiable bullet according to claim 1, wherein said plurality of identification codes consists of two sets of identification codes.

3. The identifiable bullet according to claim 2, wherein said first set of identification codes is placed inside said jacket, and said second set of identification codes is placed on the surface of the jacket.

4. The identifiable bullet according to claim 3, wherein said first set of identification codes is encrypted.

5. The identifiable bullet according to claim 1, wherein each of said identification codes is placed in or on a part of different material.

* * * * *